United States Patent [19]

Young

[11] Patent Number: 4,526,243

[45] **Date of Patent: * Jul. 2, 1985**

[54] DRILLING HEAD

[75] Inventor: David E. Young, Houston, Tex.

[73] Assignee: Smith International, Inc., Newport Beach, Calif.

[ * ] Notice: The portion of the term of this patent subsequent to Oct. 6, 1998 has been disclaimed.

[21] Appl. No.: 323,758

[22] Filed: Nov. 23, 1981

[51] Int. Cl.[3] ..... E21B 3/04

[52] U.S. Cl. ..... 175/195; 166/84; 277/31; 285/414

[58] Field of Search ..... 166/82, 84; 175/195, 175/209, 210; 277/31; 285/414

[56] References Cited

U.S. PATENT DOCUMENTS

| | | | |
|---|---|---|---|
| 3,418,009 | 12/1968 | Polla | 285/414 X |
| 3,836,183 | 9/1974 | Battle | 285/414 |
| 4,157,186 | 6/1979 | Murray et al. | 277/31 |
| 4,208,056 | 6/1980 | Biffle | 277/31 |
| 4,293,047 | 10/1981 | Young | 175/195 |
| 4,312,404 | 1/1982 | Morrow | 277/31 |

*Primary Examiner*—James A. Leppink
*Assistant Examiner*—Hoang C. Dang

[57] ABSTRACT

Drilling head incorporating downwardly facing lip type bearing seals, stationary seal cartridge for head seal, rotating replaceable seal bushing for head seal, and optional screw connection for removable side outlet.

8 Claims, 3 Drawing Figures

Fig. 3

| ITEM | | DESCRIPTION | QTY |
|---|---|---|---|
| 1 | | BEARING INNER RETAINER | 1 |
| 2 | | BEARING UPPER SEAL RETAINER | 1 |
| 3 | | BEARING SEAL, GARLOCK 23x7175 | 2 |
| 4 | | BUTTON HEAD CAPSCREW, $\frac{1}{4}$-20x$\frac{1}{2}$ | 9 |
| 5 | | SOCKET HD CAPSCREW, M12-1.75x50 | 28 |
| 6 | | BEARING OUTER RETAINER | 1 |
| 7 | | SPLINED DRIVE RING | 1 |
| 8 | | 'O' RING, 2-278 N674-70 | 1 |
| 9 | | BEARING HOUSING | 1 |
| 10 | | BEARING LOWER SEAL SLEEVE | 1 |
| 11 | | BEARING LOWER SEAL SHOE | 1 |
| 12 | | BEARING LOWER SEAL RETAINER | 1 |
| 13 | | FLOW DEFLECTOR | 1 |
| 14 | | 'O' RING, 2-279 N674-70 | 1 |
| 15 | | 'O' RING, 2-458 N674-70 | 2 |
| 16 | | SOCKET HD CAPSCREW, M16-2.0x70 | 8 |
| 17 | | SPLIT RING STRIPPER RETAINER | 1 |
| 18 | | PACKING SLEEVE RETAINER | 1 |
| 19 | | PACKING INNER SLEEVE | 1 |
| 20 | | PACKING OUTER SLEEVE | 1 |
| 21 | | PACKING SNAP RING | 1 |
| 22 | | PACKING V RING SET, 4 PIECES | 1 SET |
| 23 | | PACKING ADAPTER SET, 3 PIECES | 1 SET |
| 24 | | PACKING SPRING | 1 |
| 25 | | BEARING ASSEMBLY | 1 |
| 26 | | SOCKET HD CAPSCREW, M12 x1.75x20 | 4 |
| | | (FOR ITEM 18, NOT SHOWN) | |

DRILLING HEAD

SUMMARY OF THE INVENTION

This invention relates to improvements to the drilling head disclosed in applicant's prior U.S. Pat. No. 4,293,047 issued Oct. 6, 1981, the disclosure of which is incorporated herein by reference. The improvements include improved bearing seals, rotating seal, and outlet connection.

BRIEF DESCRIPTION OF THE DRAWINGS:

FIG. 3 is a parts list identifying the parts shown in FIG. 2.

Figure 1:
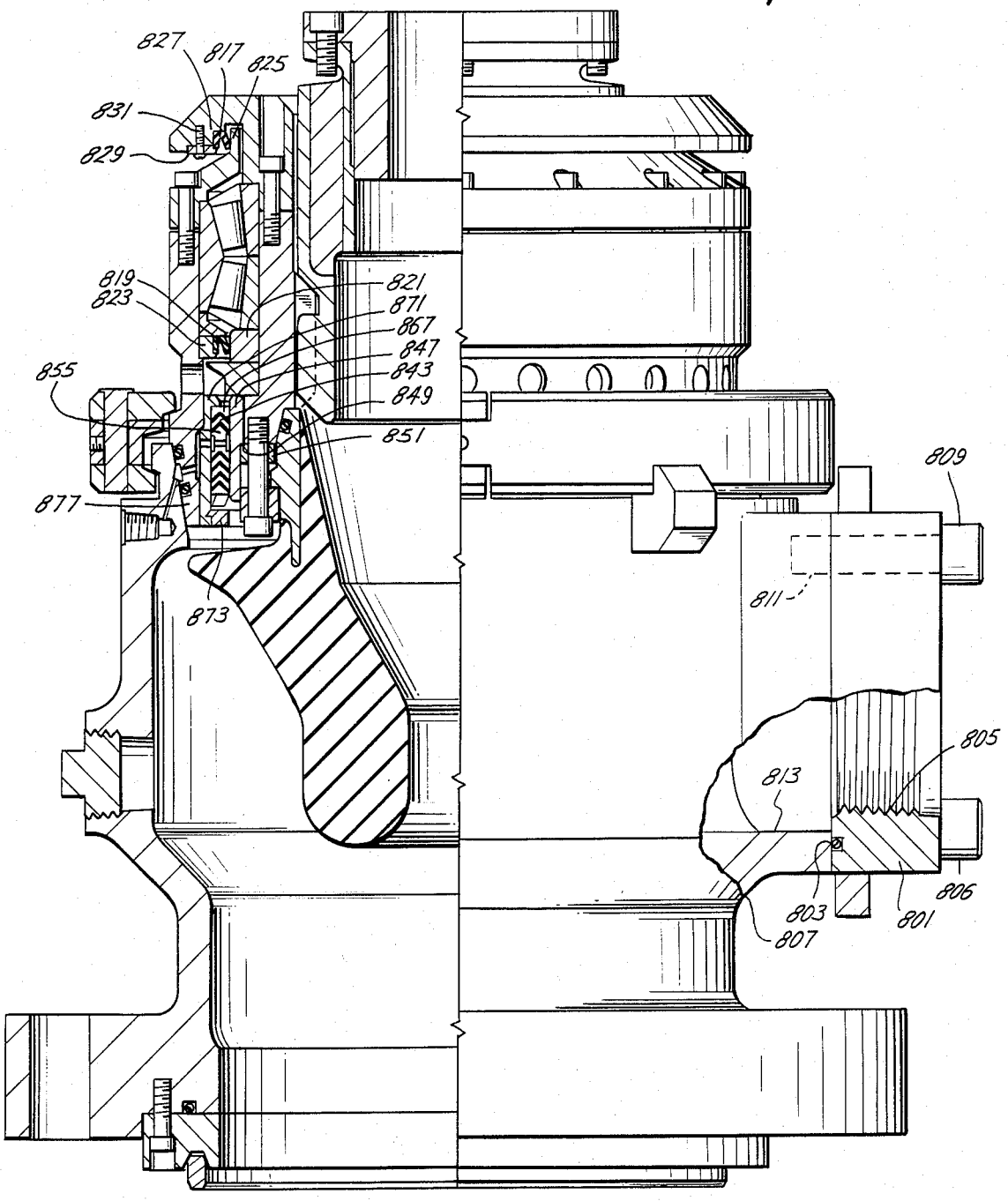
FIG. 1 is a quarter section of a drilling head embodying the invention.

DETAILED DESCRIPTION OF PREFERRED EMBODIMENT:

Referring to FIG. 1, the construction is the same as in the aforementioned patent except as follows:

A. In place of a bushed flanged connector releasably bolted to the body outlet there is substituted a coupling ring 801 which is sealed to the body by O-ring 803 and is internally taper threaded at 805, the ring being held to body 807 by a plurality of cap screws 809 received in nonuniformly spaced threaded holes 811 azimuthally spaced apart about the axis of flow outlet 813. The threaded ring 15 more adaptable than the flanged connector. The latter is available for use whenever abrasive fluid is to be handled.

Figure 2:
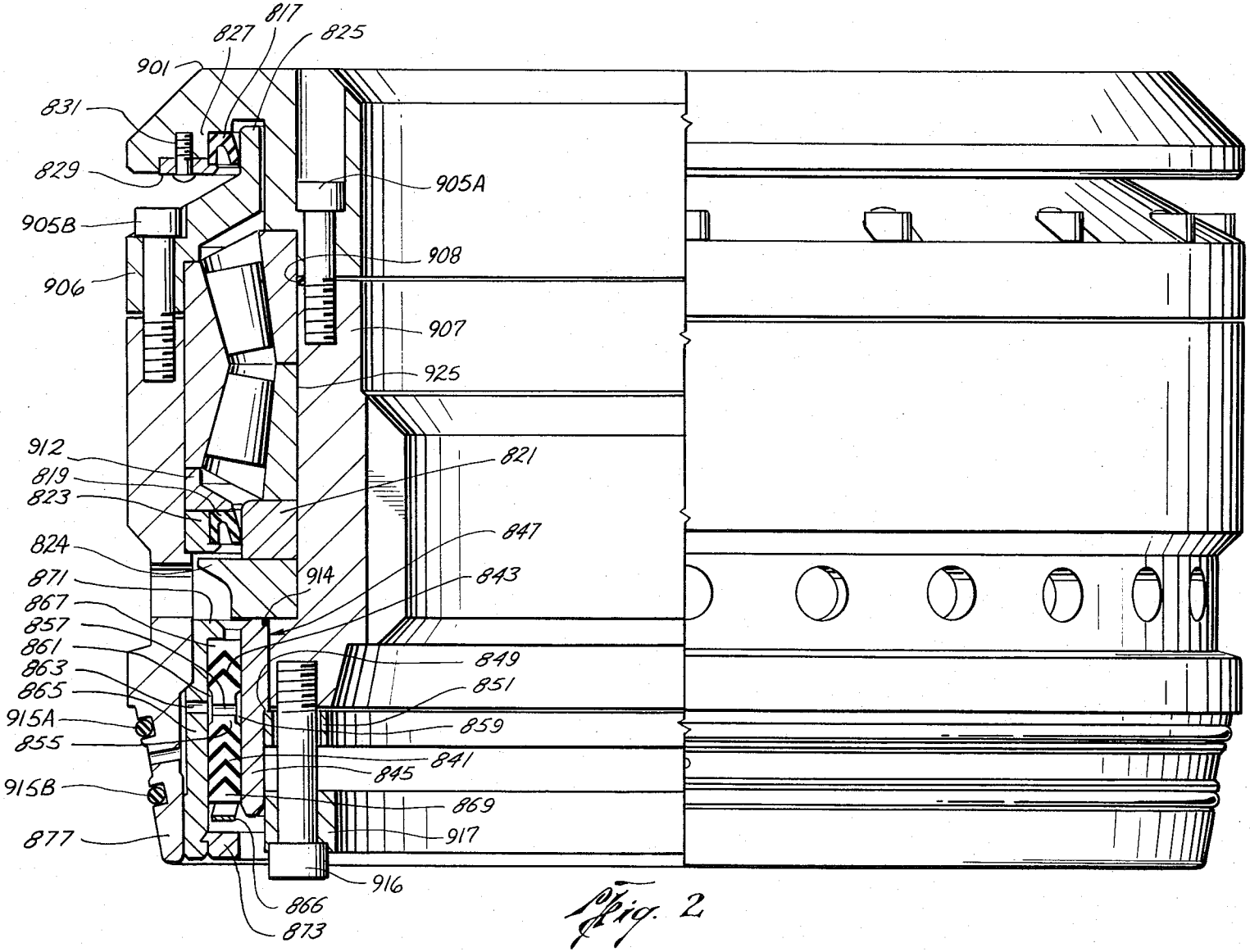
FIG. 2 is a view similar to FIG. 1 showing the removable part of the drilling head.

B. Referring now also to FIG. 2 and to the parts list in FIG. 3, face seals 209, 215 sealing the bearings of the patented construction are replaced by upper and lower downwardly facing double lip radial seals 817, 819, item 3 on the parts list, made of flexible, resilient compliant sealing material such as rubber. Lower seal 819 seals between inner and outer bearing blocks 821, 823, items 10 and 11 on the parts list, sleeve 821 surmounting a diverter ring 824 therebelow, being item 13 in the parts list (compare end ring 193 of the FIG. 4A construction of patent 4,293,647). Upper seal 819 seals between telescoping, axially extending inner and outer flanges 825, 827 and is retained by ring 829, item 2 on the parts list, secured by a plurality of annularly disposed azimuthally spaced screws 831, item 4 on the parts list.

The advantage of this construction is that dirt and debris tend to fall downwardly away from the seals, thereby preventing damage to the seals and consequent leakage. Compare U. S. Pat. No. 4,262,960 to Garrett. For radial seals, lip seals are better than O-ring seals.

C. The rotating seal between the rotor and stator, comprising in the patented construction stationary hard wear bushing 121 and rotating compliant rings 279 is replaced by stationary compliant rings 841, 843, item 22 on the parts list, and rotating hard wear sleeve 845, item 19 on the parts list, over which is disposed diverter ring 824.

Sleeve 227 with flange 229 which secured the seal ring cartridge to the rotor in the patented construction (see FIG. 5B thereof) is replaced by sleeve 845 having only a slight inturned flange 847 forming downwardly facing internal shoulder 849 and a separate flange ring or support 851, item 18 on the parts list, engaging the shoulder. Ring 851 is secured to the rotor by screws, (not shown), item 26 on the parts list the same as screws 233 in the patented construction. Wear sleeve 845 is easily replaceable and economically manufactured.

Stationary seal rings 841, 843 are separated by metal or hard plastics junk ring 855, the middle one of the three pieces forming the packing adapter set, item 23 on the parts list, through which extends one or more lubricant passages 857, passages 857 opening into annular inner and outer channels 859, 861, the latter communicating with port 863 in seal support bushing 865, item 20 on the parts list.

The seal stack comprising wave spring 866, which is item 24 on the parts list, seal rings 841, 843, junk ring 855, and hard upper and lower metal or plastics end rings 867 and 869, the rings being the upper and lower ones of the three pieces forming the packing adapter set, item 33 on the parts list, are captured between inturned flange 871 at the upper end of bushing 865 and split snap ring 873, item 21 on the parts list. Wave spring 866 eliminates any play in the seal stack.

Support bushing 865 is pressed into stator tapered pin 877, the lower part of the bearing housing, item 9 on the parts list, and thus is held in place by an interference fit.

It is easier to machine the outer surface of hard wear sleeve 845 than the inner surface of the wear bushing of the patented construction.

Further referring to FIGS. 2 and 3, the bearing inner retainer, item 1 on the parts list, is shown at 901, the retainer being secured to splined drive ring 907, item 7 on the parts list, by cap screws 905A, part of item 5 on the parts list. Similarly, bearing outer retainer 906, item 6 on the parts list, is secured to the aforementioned bearing housing by cap screws 905B, part of item 5 on the parts list. An O-ring 908, item 8 on the parts list, seals inner retainer 901 the drive ring 907.

Lower bearing seal retainer 912, item 12 on the parts list, is disposed within the bearing housing above bearing seal 819. O-ring seal 914, item 14 on the parts list, seals diverter ring 824 to the upper end of packing sleeve 845. O-ring seals 915A, 915B, item 15 on the parts list, seal lower part 877 of the bearing housing to the body of the drilling head at a level above flow outlet 813 of the drilling head (see FIG. 1).

Cap screws 916, item 16 on the parts list secure split ring stripper retainer 917, item 17 on the parts list, to splined drive ring 907, with the metal flange of the stripper rubber (not shown in FIG. 2) captured between retainer 917 and packing sleeve retainer 851 as shown in FIG. 1.

While a preferred embodiment of the invention has been shown and described, modifications can be made by one skilled in the art without departing from the spirit of the invention.

I claim:

1. A drilling head comprising a stator having an opening therethrough, a rotor disposed in said stator opening and having a passage through which a drill string drive tube may extend, bearing means rotatably mounting the rotor in the stator, said bearing means including an outer stationary race and an inner rotating race and rolling elements for rolling in lubricant between said races, downwardly converging flexible means carried by the rotor adapted to engage the drive tube of a drill string, rotating seal means to seal between the rotor and stator, first means sealing between said stator and rotor above said bearing means and comprising inner and outer telescoping members with first double lip seal means therebetween, said inner member being fixed relative to said outer race and said outer member being fixed relative to said inner race, said first double lip seal means including an interior face exposed to said lubricant and an exterior face exposed to the atmosphere, the exterior face of said first double lip seal means being downwardly facing.

2. Drilling head according to claim 1, said first double lip seal means including a ring from which inner and outer annular lips extend downwardly.

3. Drilling head according to claim 1, further including second means sealing between said stator and rotor below said bearing means and comprising inner and outer concentric annular members with second downwardly facing double lip seal means therebetween, said inner annular member being fixed relative to said inner race and said outer annular member being fixed ralative to said outer race, said second double lip seal means including a ring from which inner and outer lips extend downwardly.

4. Drilling head according to claim 1, said rotating seal means including a seal ring cartridge retained in said stator and a wear sleeve releasably secured to said rotor, said seal cartridge including a support sleeve having inwardly protuberant annular means with a seal stack captured therebetween, said seal stack including a plurality of seal rings and an annular wave spring, said support sleeve being press fitted in said stator.

5. Drilling head according to claim 1, including an outlet port in the stator below said rotating seal means and having a vertical extent terminating adjacent the lower end of said flexible means, said stator having a plane surface around said port on the outside of the stator, and an internally threaded ring flange secured to said stator and having a plane face correlative to and in engagement with said plane face of the stator and sealed thereto, the inner diameter of said port being larger than the inner diameter of said internally threaded ring flange whereby a pipe screwed into said internally threaded ring flange can extend through said flange into said port.

6. A drilling head comprising a stator having an opening therethrough, a rotor disposed in said stator opening and having a passage through which a drill string drive tube may extend, bearing means rotatably mounting the rotor in the stator, said bearing means including an outer stationary race and an inner rotating race and rolling elements for rolling in lubricant between said races, downwardly converging flexible means carried by the rotor adapted to engage the drive tube of a drill string, rotating seal means to seal between the rotor and stator, first and second means sealing between said stator and rotor respectively above and below said bearing means and each comprising inner and outer concentric annular members with double lip seal means therebetween, said inner member of said first means being fixed relative to said outer stationary race and said outer member of said first means being fixed relative to said inner rotating race, said inner member of said second means being fixed relative to said inner rotating race and said outer member of said second means being fixed relative to said outer stationary race, said double lip seal means each including a ring from which inner and outer annular lips extend downwardly, said first double lip seal means including an interior face exposed to said lubricant and an exterior face exposed to the atmosphere, the exterior face of said first double lip seal means being downwardly facing, said second double lip seal means being disposed in said outer member of said second means sealing between said stator and rotor, said outer member with which said second double lip seal means seals providing a stationary housing around outside of said second double lip seal means.

7. Drilling Head according to claim 6, said rotor including diverter ring means above said rotating seal means to direct leakage past said rotating seal means laterally outwardly through ports in said stator, said diverter ring means being disposed below said second double lip seal means and extending thereunder, said second double lip seal means facing downwardly toward said diverter ring.

8. Drilling head according to claim 7, said rotating seal means including a seal ring cartridge retained in said stator and a wear sleeve releasably secured to said rotor, said wear sleeve bearing at its upper end against said diverter ring means which extends over the upper end of the wear sleeve.

* * * * *

UNITED STATES PATENT AND TRADEMARK OFFICE

CERTIFICATE OF CORRECTION

PATENT NO. : 4,526,243

DATED : JULY 2, 1985

INVENTOR(S) : DAVID E. YOUNG

It is certified that error appears in the above—identified patent and that said Letters Patent is hereby corrected as shown below:

Column 2, Line 16; change "33" to -- 23 --.

Column 2, Line 55; after "comprising" insert -- : --.

Column 3, Line 50; after "comprising" insert -- : --.

Signed and Sealed this

*Fifteenth* Day of *October 1985*

[SEAL]

*Attest:*

*Attesting Officer*

DONALD J. QUIGG

*Commissioner of Patents and Trademarks—Designate*